US006264196B1

(12) United States Patent
Lötsch

(10) Patent No.: US 6,264,196 B1
(45) Date of Patent: Jul. 24, 2001

(54) METHOD AND DEVICE FOR LATERALLY ALIGNING A SHEET

(75) Inventor: Kurt Lötsch, Wiesenbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 253 days.

(21) Appl. No.: 08/851,017

(22) Filed: May 5, 1997

(30) Foreign Application Priority Data

May 4, 1996 (DE) ..... 196 18 030

(51) Int. Cl.[7] ..... B65H 7/02

(52) U.S. Cl. ..... 271/228; 271/82; 271/277; 271/226; 271/249

(58) Field of Search ..... 271/82, 277, 226, 271/228, 241, 249; 101/410, 408

(56) References Cited

U.S. PATENT DOCUMENTS

| | | | | |
|---|---|---|---|---|
| 3,100,637 | * | 8/1963 | Brown | 271/277 |
| 4,588,184 | | 5/1986 | Jeschke . | |
| 4,823,159 | * | 4/1989 | Yamamoto et al. | 271/249 |
| 4,833,989 | * | 5/1989 | Wieland | 271/82 |
| 5,219,159 | * | 6/1993 | Malachowski et al. | 271/236 |
| 5,273,274 | * | 12/1993 | Thomson et al. | 271/228 |

FOREIGN PATENT DOCUMENTS

| | | |
|---|---|---|
| 2520232 | 11/1976 | (DE) . |
| 2808528C3 | 10/1981 | (DE) . |
| 2924636C2 | 1/1985 | (DE) . |
| 3311196C2 | 7/1987 | (DE) . |
| 3644431A1 | 9/1988 | (DE) . |

* cited by examiner

*Primary Examiner*—H. Grant Skaggs
(74) *Attorney, Agent, or Firm*—Herbert L. Lerner; Laurence A. Greenberg; Werner H. Stemer

(57) ABSTRACT

A method for laterally aligning a sheet in a sheet-processing machine, the sheet being retained by sheet grippers which are displaced axially on a common carriage with respect to an alignment cylinder, includes fixing the carriage when it reaches a predetermined desired position; and device for performing the method.

9 Claims, 3 Drawing Sheets

METHOD AND DEVICE FOR LATERALLY ALIGNING A SHEET

BACKGROUND OF THE INVENTION

Field of the Invention

The invention relates to a method and a device for laterally aligning a sheet, more particularly, by an axially displaceable sheet gripper device on a cylinder or a drum of a sheet-processing machine, having a control roller and a cam disk cooperating with the control roller at an end face.

The published German Patent Document DE 36 44 431 A1 discloses a cam disk which is mounted on a side frame so that it can pivot in the axial direction of a cylinder carrying sheet grippers. An adjusting movement is produced by an adjusting motor and adjusting gearing connected downstream of the latter. The cam disk is respectively pivoted only to the extent which is intended to correspond to the axial displacement of a carriage.

SUMMARY OF THE INVENTION

It is an object of the invention to provide a method and a device for an axial adjusting movement of a sheet gripper device, wherein a cam disk is arranged in a stationary manner, which provides a considerable improvement over the state of the art.

With the foregoing and other objects in view, there is provided, in accordance with one aspect of the invention, a method for laterally aligning a sheet in a sheet-processing machine, the sheet being retained by sheet grippers which are displaced axially on a common carriage with respect to an alignment cylinder, which comprises fixing the carriage when it reaches a predetermined desired position.

In accordance with another mode, the method of the invention includes axially displacing the carriage and the sheet retained thereon with respect to the alignment cylinder, from a given position, until a sensor identifying a desired position emits a signal to fix the carriage, and then fixing the carriage.

In accordance with a further aspect of the invention, there is provided a device for laterally aligning a sheet by an axially displaceable sheet gripper device on a cylinder or a drum of a sheet-processing machine, having a control roller and a cam disk cooperating with the control roller at an end face, comprising a carriage to which the sheet gripper device is fastened, and a braking system by which the carriage is fixable with respect to the alignment cylinder.

In accordance with another feature of the invention, the braking system includes a strip and two activatable brake blocks for clamping the strip.

In accordance with a further feature of the invention, the carriage is axially displaceably mounted in a cylinder gap formed in the sheet alignment cylinder.

In accordance with an added feature of the invention, the cam disk is mounted fixedly on the frame and has a control contour within an effective range of a control roller.

In accordance with an additional feature of the invention, the aligning device includes a sheet lateral position detection system connected to the braking system.

In accordance with yet another feature of the invention, the device includes a first spring element for producing at least one of a restoring movement and a deflecting movement of the carriage.

In accordance with a concomitant feature of the invention, the control roller is displaceable with respect to the carriage, the control roller being displaceable counter to a force of a second spring element.

The advantage of the invention resides, in particular, in the fact that a sheet to be transported can be aligned laterally even at high processing speeds. In an advantageous manner, braking of the lateral movement of the gripper carriage can be performed significantly faster than driving to a desired position by an adjusting motor. Sensors which are provided for the detection of the sheet side positions are integrated in the alignment cylinder. By this measure, the actual lateral position (nominal value) of the sheet in relation to the cylinder is measured.

Other features which are considered as characteristic for the invention are set forth in the appended claims.

Although the invention is illustrated and described herein as a method and device for laterally aligning a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
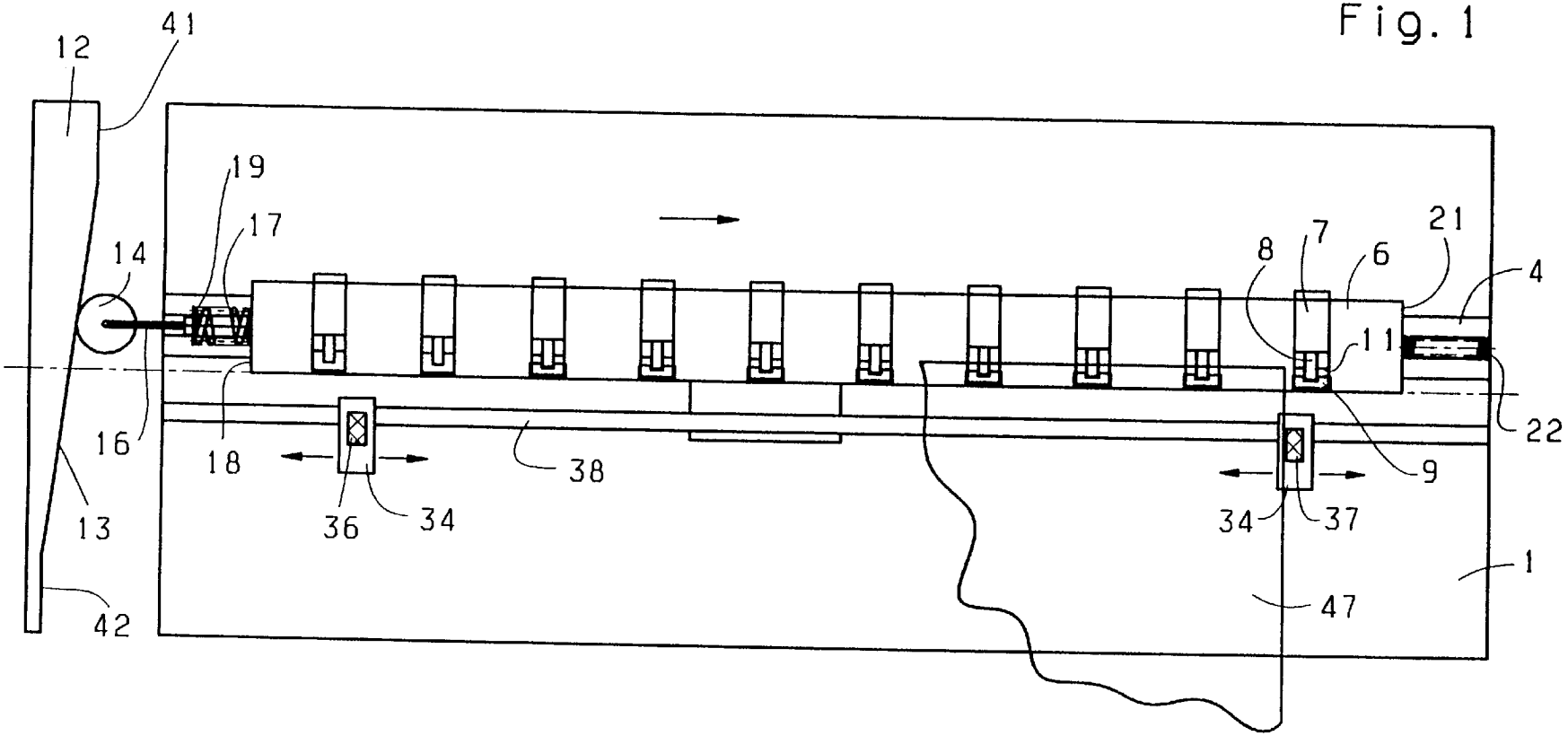
FIG. 1 is a diagrammatic top plan view of a sheet alignment cylinder incorporating the device according to the invention.
Figure 2:
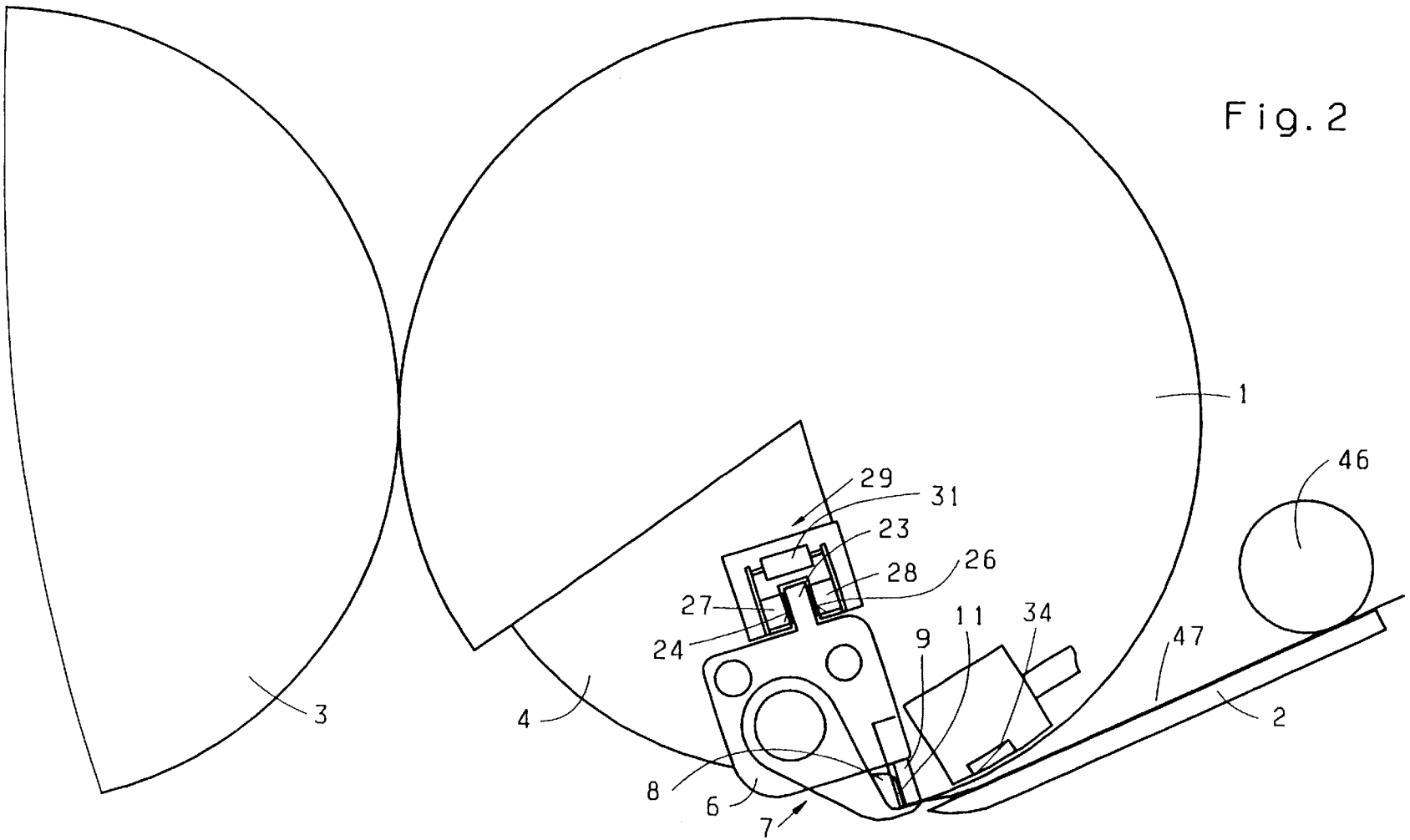
FIG. 2 is an enlarged diagrammatic end view of the sheet alignment cylinder of FIG. 1.

Referring now to the drawings and, first, particularly to FIGS. 1 and 2 thereof, there is shown therein a sheet alignment cylinder 1 of a sheet-fed rotary printing machine arranged between a feeder table 2 and an impression cylinder 3. The sheet alignment cylinder 1 has an axially parallel cylinder gap or channel 4 formed therein, in which a carriage 6 is axially movably mounted. The carriage 6 carries a number of sheet gripper devices 7, which are arranged alongside one another and spaced apart from one another and are controlled in a conventional manner. Each sheet gripper has a gripper finger 8, a gripper pad 9 cooperating with the latter and a sheet leading edge alignment lay 11 (front lay). A cam disk 12 having a control contour 13 formed on the end face thereof is arranged in a fixed manner, but able to be rotated in order to set control times. The cam disk 12 is effectively connected, by the control contour 13 thereof, to a control roller 14. The control roller 14 is rotatably mounted on a rod 16 which is axially displaceable with respect to the carriage 6. A compression spring 17 arranged coaxially around the rod 16 is supported on an end face 18 of the carriage 6 and on a shoulder 19 of the rod 16 and thus ensures that the control roller 14 introduces an axial adjusting movement of the carriage 6 up to a force corresponding to the force of the compression spring 17. On an end face 21 of the carriage 6 which faces away from the cam disk 12, there is arranged a second compression spring 22, which is dimensioned to be smaller than the compression spring 17 and applies a restoring force. This spring 22 is supported at one end thereof on the end face 21 and at the other end thereof on an inner wall of the sheet alignment cylinder 1.

On a side facing away from the sheet gripper device 7, the carriage 6 has a strip 23 with two parallel side walls 24 and 26 (FIG. 2). During the axial deflection of the carriage 6, the strip moves between two brake blocks 27 and 28 of a braking system 29 fixed to the cylinder. An operating cylinder 31 of the braking system 29 can be activated hydraulically or pneumatically, and preferably magnetically. When activated, the operating cylinder actuates the brake blocks 27 and 28 in such a manner that the latter clamp the projection 23 firmly, so that the carriage 6 is fixed.

A sheet detection system 34 of conventional construction for the purpose of detecting the position of the sheet side edges is arranged parallel to the cylinder gap or channel 4, as viewed in the sheet transport direction, in front of the cylinder gap or channel 4 and within the periphery of the alignment cylinder 1. The system includes two sensors 36 and 37. In this case, the sensor 36 is provided for detecting the left-hand and the sensor 37 for detecting the right-hand sheet side edges. In order to set the format, the sensors 36 and 37 are axially adjustably mounted on a spindle 38 having contrarotating threads. The sensors 36 and 37 are connected to the braking system 29 via a computing/control unit of conventional construction.

Figure 3:
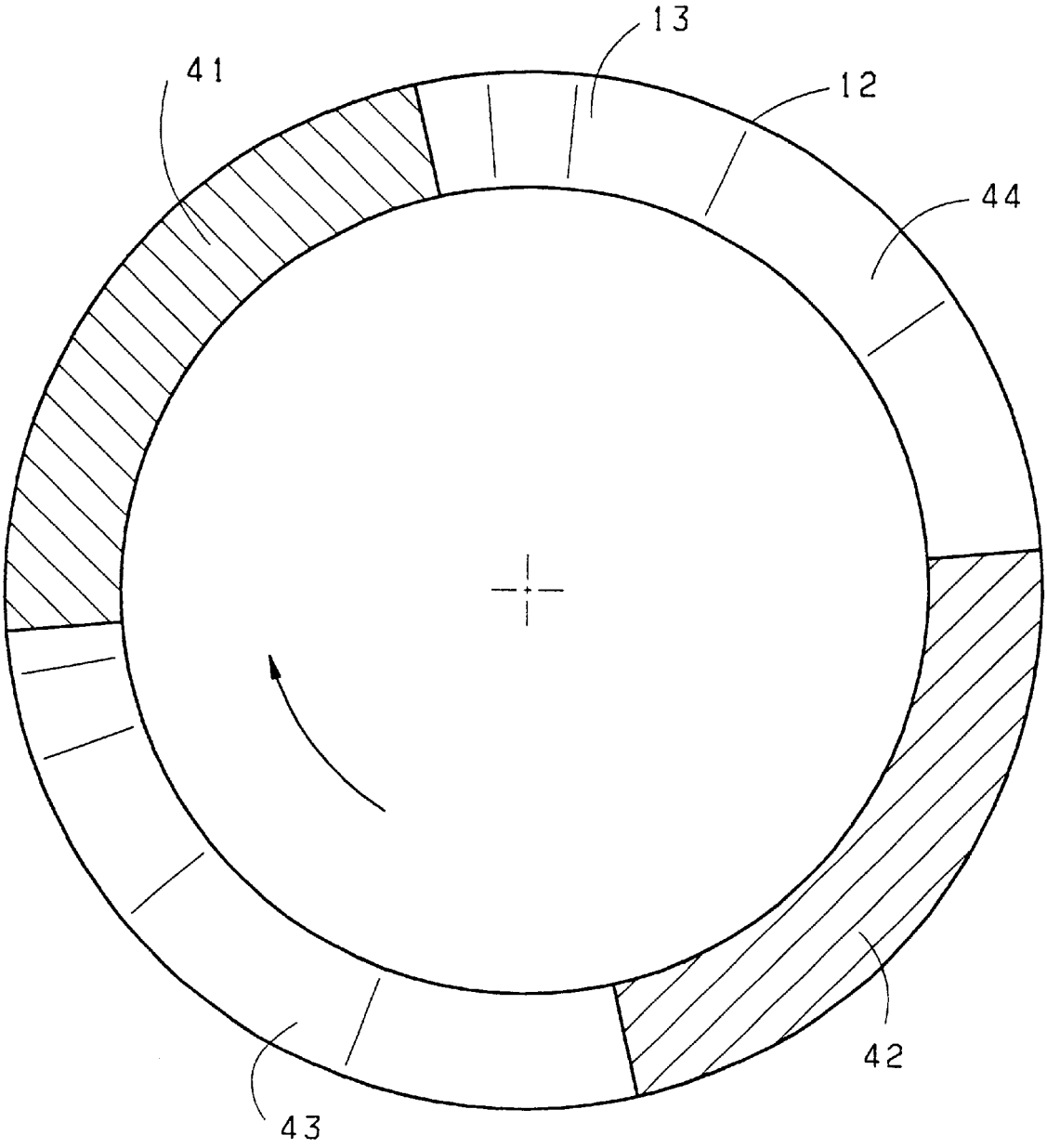
FIG. 3 is an enlarged diagrammatic top plan view of a control contour of a cam disk shown at the right-hand side of FIG. 1.

As shown in FIG. 3, the control contour 13 of the cam disk 12 has a control cam 41 having a resting region and a control valley 42 having a resting region. A control region having a rise 43 or a fall 44 is, respectively, arranged between the control cams 41 and 42. The running direction of the control roller 14 on the control contour 13 corresponds to the arrow in FIG. 3.

A sheet 47 which is conveyed on the feeder table 2 supported by a cyclically operated roller 46 is conveyed with the leading edge thereof directly into the sheet gripper device 7 of the sheet alignment cylinder 1 and is aligned on the front lays 11. The control roller 14 is located in the resting region of the control valley 42 during this process. After the grippers have been closed, the control roller 14 passes onto the rise of the control region 43 and displaces the carriage 6, together with the sheet 47, axially to the right-hand side with respect to the alignment cylinder 1 and counter to the force of the compression spring 22, until the sheet lateral edge reaches the sensor 37. A pulse conducted from the sensor 37 to the computing/control unit activates the braking system 29 and fixes the carriage 6 in the desired axial position. The sheet 47 which has been aligned in this manner is transferred to the downstream impression cylinder 3. If, at the instant of the fixing of the carriage 6, the control roller 14 is still on the rise of the control region 43, the further overstroke is absorbed by displacing the rod 16 with respect to the alignment cylinder 1 counter to the force of the compression spring 17. The release of the braking system 29 occurs following the sheet transfer, preferably at the instant when the control roller 14 reaches the fall region in the vicinity of the control region 44, which corresponds to the rise region at which the carriage 6 was fixed.

If a sheet 47 is intended to be pulled to the left-hand side for its alignment, so that the sensor 36 is used for determining the lateral position of the sheet 47, the cam disk 12 can be pivoted through 180 degrees and then fixed once more.

The alignment process is performed inversely proportionally to that described previously, the sheet 47 being taken over from the feeder table 2 when the control roller 14 is located in the resting region of the control cam 41.

I claim:

1. A method for laterally aligning a sheet in a sheet-processing machine, the sheet being retained by sheet grippers which are displaced axially on a common carriage with respect to an alignment cylinder, which comprises fixing the carriage when it reaches a predetermined desired position by exerting a braking force on the carriage.

2. The method as claimed in claim 1, which includes axially displacing the carriage and the sheet retained thereon with respect to the alignment cylinder, from a given position, until a sensor identifying a desired position emits a signal to fix the carriage, and then fixing the carriage.

3. A device for laterally aligning a sheet by an axially displaceable sheet gripper device on a cylinder or a drum of a sheet-processing machine, having a control roller and a cam disk having an end face cooperating with the control roller at the end face, comprising a carriage to which the sheet gripper device is fastened, and a braking system by which said carriage is fixable with respect to the alignment cylinder.

4. The device as claimed in claim 3, wherein said carriage has a strip and said braking system includes two activatable brake blocks for clamping said strip.

5. The device as claimed in claim 4, wherein said carriage is axially displaceably mounted in a cylinder gap formed in the sheet alignment cylinder.

6. The device as claimed in claim 4, wherein said cam disk is mounted fixedly on the frame and has a control contour within an effective range of a control roller.

7. The device as claimed in claim 3, including a sheet lateral position detection system connected to said braking system.

8. The device as claimed in claim 3, including a first spring element for producing at least one of a restoring movement and a deflecting movement of said carriage.

9. The device as claimed in claim 3, wherein said control roller is displaceable with respect to said carriage, said control roller being displaceable counter to a force of a spring element.

* * * * *